US011892268B1

(12) United States Patent
Coombs et al.

(10) Patent No.: US 11,892,268 B1
(45) Date of Patent: Feb. 6, 2024

(54) BUTTSTOCK ACCESSORY PORT SYSTEM AND DEVICE

(71) Applicant: Amend2, LLC, Idaho City, ID (US)

(72) Inventors: Colby Coombs, Idaho Falls, ID (US); Matthew Bellitti, Idaho Falls, ID (US); Austin Damoth, Idaho Falls, ID (US); Craig Lockwood, Idaho Falls, ID (US)

(73) Assignee: Amend2, LLC, Idaho Falls, ID (US)

( * ) Notice: Subject to any disclaimer, the term of this patent is extended or adjusted under 35 U.S.C. 154(b) by 0 days.

(21) Appl. No.: 17/978,606

(22) Filed: Nov. 1, 2022

(51) Int. Cl.
*F41C 23/20* (2006.01)

(52) U.S. Cl.
CPC ..... *F41C 23/20* (2013.01)

(58) Field of Classification Search
CPC ..... F41C 23/00; F41C 23/08; F41C 23/10
USPC ..... D22/108, 111
See application file for complete search history.

(56) References Cited

U.S. PATENT DOCUMENTS 1,099,992 A * 6/1914 Micke ..... F41A 17/38 42/6
1,266,024 A * 5/1918 Kennedy ..... F41C 23/20 42/74
2,667,005 A * 1/1954 Weis ..... F41C 23/22 42/74
2,763,951 A * 9/1956 Harvey ..... F41C 23/22 42/71.01
2,766,542 A * 10/1956 Harvey ..... F41C 23/22 42/71.01
3,618,248 A * 11/1971 Into et al. ..... F41C 23/22 42/71.01
5,225,613 A * 7/1993 Claridge ..... F41C 23/22 42/74
6,543,172 B1 * 4/2003 Armstrong ..... F41C 23/08 42/71.01
7,762,018 B1 * 7/2010 Fitzpatrick ..... F41C 23/22 42/73
D697,162 S * 1/2014 Faifer ..... D22/108
8,978,284 B1 * 3/2015 Zusman ..... F41C 23/14 42/1.06
9,279,640 B1 * 3/2016 Hurley ..... F41C 23/22
9,909,835 B1 * 3/2018 Smith ..... F41C 23/08
11,150,048 B1 * 10/2021 Stephens ..... F41C 23/22
2007/0261284 A1 * 11/2007 Keng ..... F41C 23/22 42/71.01
2009/0178323 A1 * 7/2009 Fluhr ..... F41C 23/20 42/71.01
2009/0255161 A1 * 10/2009 Fitzpatrick ..... F41C 23/22 42/90
2010/0242333 A1 * 9/2010 Kincel ..... F41C 23/14 42/73
2010/0242334 A1 * 9/2010 Kincel ..... F41C 23/14 42/74
2011/0099872 A1 * 5/2011 Bentley ..... F41C 23/22 42/71.01
2011/0154707 A1 * 6/2011 Noonan ..... F41C 23/06 42/1.06

(Continued)

*Primary Examiner* — Joshua E Freeman
(74) *Attorney, Agent, or Firm* — Travis Banta; Loyal IP Law, PLLC

(57) ABSTRACT

The present disclosure relates a buttstock accessory port system, comprising a body, a recoil pad, and an insert. The body includes a bridge and a cavity. The recoil pad attaches to the body and incudes an opening. The insert is insertable through the recoil pad opening and insertable into the cavity of the body.

20 Claims, 3 Drawing Sheets

(56) References Cited

U.S. PATENT DOCUMENTS

| | | | | |
|---|---|---|---|---|
| 2011/0173863 | A1* | 7/2011 | Ingram | F41C 23/14<br>42/74 |
| 2011/0192067 | A1* | 8/2011 | Troy | F41C 23/06<br>42/73 |
| 2012/0000109 | A1* | 1/2012 | Zusman | F41C 23/14<br>42/71.01 |
| 2016/0010944 | A1* | 1/2016 | Downey | F41C 23/14<br>42/74 |
| 2019/0128629 | A1* | 5/2019 | Murphy, II | F41A 17/54 |

* cited by examiner

BUTTSTOCK ACCESSORY PORT SYSTEM AND DEVICE

BACKGROUND

The first firearms use largely began in the 14th century and were implemented as small enough cannons to be held by a man and were descriptively referred to as a hand cannon. The user held a wooden body fitted to a socket at an end of the cannon. These firearms required a match, spark, or ember to light primer powder disposed in a flash pan to fire these primitive firearms. In time, a matchlock mechanism was developed which lowered a match to the flash pan of the firearm when a trigger was pulled. This allowed the user to hold and aim a gun while waiting for it to fire. Matchlock firearms included a wooden stock to aid the user and was held up against the shoulder or under the arm of the user allowing the user to steady the firearm.

Even though the matchlock mechanism allowed the user to aim a matchlock firearm, an external fire source to light the matchlock was still necessary to ignite gunpowder when the trigger was pulled. The flintlock mechanism improved upon the matchlock because the flintlock mechanism created a spark, on demand, when the trigger was pulled to ignite primer powder in a flash pan. A small advancement in gunstock technology includes attaching a sling to the gunstock The problem with the flintlock mechanism is that the flint caused misfires in inclement weather and failed to ignite wet powder making the reliability of firearms with a flintlock mechanism questionable. This prompted the creation of a percussion cap. Percussion caps contained a dry mixture of chemicals which were explosively sensitive to shock (e.g., from a falling hammer on a firearm) and allowed a user to fire reliably regardless of the weather. Percussion caps, containing a shock-sensitive explosive, ignited upon the impact of a firearm hammer that was released when the trigger was pulled which allowed fire created by the explosion to ignite gunpowder within the firearm and fire a bullet. As the technology advanced from matchlock to percussion firearms, the mechanics of the gunstock changed little.

As firearms improved so did the ammunition used with the firearms. Ammunition used in a cannon was round (e.g., a ball) and advanced from stone to iron and later to lead. Cannon balls were installed in a barrel and rammed into a seated position on top of gunpowder in the cannon, or on a wad between the gunpowder and the cannon ball. These cannon balls were wildly inaccurate because of an unpredictable spin that occurred when the cannon balls were fired. Firearms of the era were also "smoothbore" (e.g., lacking grooves) which allowed unpredictable spin on a lead ball or cannon ball. To improve accuracy, helical grooves were machined into the inside of barrels in both cannons and firearms. These machined grooves were called rifling and was not initially popular because rifling made rifle cleaning a substantially more difficult task. Refinements in gunpowder technology and the development of ammunition cartridges increased the popularity of rifled barrels because shooters benefited from the accuracy improvements while also reducing the work associated with cleaning a firearm barrel. Again, the gunstock remained relatively unchanged.

The development of an ammunition cartridge, which contained all the components necessary to fire a projectile from a firearm in one object, revolutionized firearms technology. Ammunition cartridges include a metallic case, preferably brass, fitted to accept a primer, gunpowder, and a projectile. More commonly, an ammunition cartridge is referred to as a "bullet" even though the projectile, the bullet, is but one element of an ammunition cartridge. One of the reasons for this clarification is that ammunition cartridges are made in different sizes. The sizes are often labeled by the diameter of the bullet also referred to as a caliber. Caliber was originally used to define the diameter of a barrel bore and now it is often used to describe bullets corresponding to the bore diameter. For example, a brass case may be a particular size, provide a primer pocket for receiving a primer of a particular size, have an internal volume of a specific size to receive gun powder, and may further accept a bullet of a particular caliber typically measured in tenths or thousandths of an inch in the United States and using metric diameter measurements in countries that use metric measurements.

The development of ammunition cartridges further improved loading of ammunition into a chamber of a firearm and the speed of firing. Two devices were created to hold ammunition in a usable position within a firearm, a clip, and a magazine. A clip groups ammunition cartridges together but has no moving parts. Firearms that use clips contain mechanisms to move the ammunition cartridge from the clip and inserts the round into a firing position in the chamber. The magazine, often mistakenly identified as a clip, aids in not only storing rounds but also moving the round into firing position by use of spring tension pushing magazines towards a top of the magazines.

As the development in ammunition cartridges improved, the gunstock for rifles and shotguns changed decoratively but included, largely, some common parts that include the butt, the comb, the heel, the toe, the grip, and the fore stock. The butt of the gunstock is the rear most part of the gun stock and is the end that is braced against the shoulder of the user. The heel is the upper corner of the butt, and the toe is the lower corner of the butt. The upper edge of the gunstock that runs from the heel forward towards the barrel is called the comb. The comb is where the face of the user rests while aiming down the barrel. The grip is positioned near the trigger and where the palm and the non-trigger finger of the shooting hand rest when shooting the firearm. Finally, the fore stock is positioned below the barrel and is where the non-shooting hand of the user is placed. Some stocks may include a thumb hole placed directly behind the grip where the thumb of the shooting hand is placed. These are the most basic parts of a common gunstock. Alterations of these main parts have been modified throughout the years for various reasons such as comfort, ergonomics, weight, and to increase shooting accuracy.

Beyond the alterations of the common parts of the gunstock here have been improvements to gunstocks that includes a collapsible stock, a telescoping stock, and a stock with a butt hook. A collapsible stock allows the stock to be folded up for better storage. The telescoping stock allows the user to adjust back and forth the butt of the gun to the desired position of the user. A butt hook is a where the toe of the stock and sometime the heel of the stock has a hook that either goes under the arm or curves over top of the shoulder to further stabilize the firearm while in use.

One of the longstanding problems of modern gunstocks is a lack of modularity. While one stock may be replaced with another customization and the ability to switch the heel or the butt or the grip has been difficult. Firearm shooters have typically needed to install different stocks on their rifles and shotguns for a particular purpose, whether they were shooting from a bench or hunting or doing competition shooting. Therefore a need exists to provide modular parts to allow a gunstock to change to fit the users purposes and desires.

SUMMARY OF THE DISCLOSURE

Disclosed herein is a buttstock accessory port system, comprising a body, a recoil pad, and an insert. The body includes a bridge and a cavity. The recoil pad attaches to the body and incudes an opening. The insert is sized to be insertable through a recoil pad opening and insertable into a cavity of the body.

Further disclosed herein is a buttstock insert that includes a vertical body, a top plate, and a cap. The vertical body includes a foot attached to a bottom portion of the vertical body. The top plate includes a projection attached a top portion of the top plate. The cap, however, attaches to the vertical body and the top plate.

Further disclosed is a buttstock insert comprising a top plate, a bottom plate, and a side plate. The top plate includes one or more projection extending upward from the top plate. The bottom plate includes one or more projection extending downward from the bottom plate. The side plate connects to the bottom plate and the top plate.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

In the following description of the disclosure, reference is made to the accompanying drawings, which form a part hereof, and in which is shown by way of illustration specific implementations in which the disclosure is may be practiced. It is understood that other implementations may be utilized, and structural changes may be made without departing from the scope of the disclosure.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are displayed or described in another embodiment or figure. In other words, elements in the figures may be interchangeable between various embodiments disclosed herein, whether shown or not.

Figure 1:
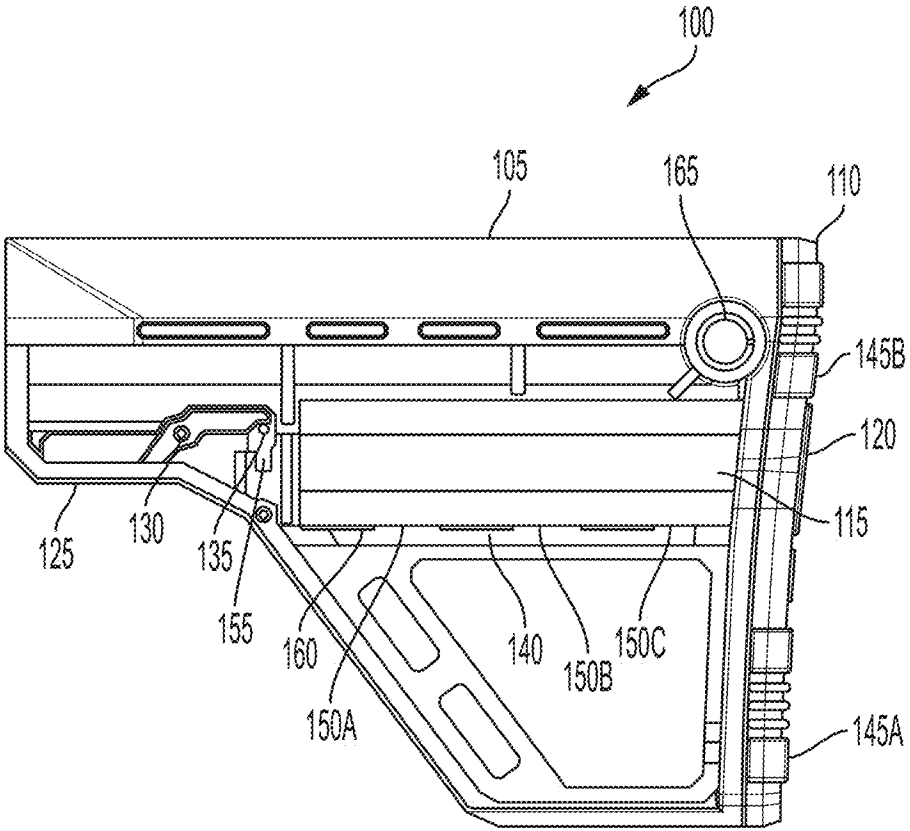
FIG. 1 illustrates a left-sided view of an embodiment of a buttstock accessory port system.
Figure 3:
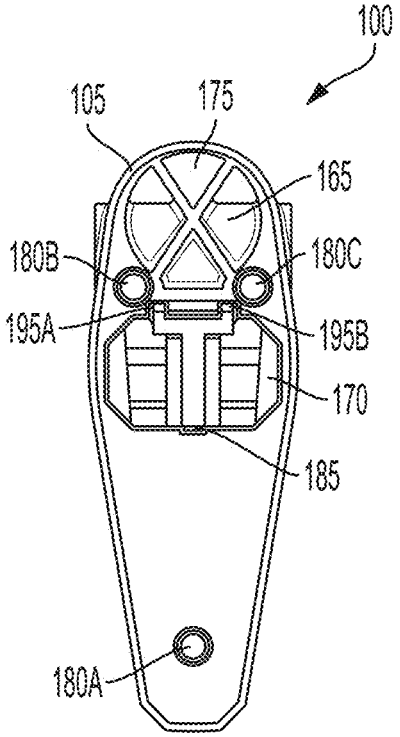
FIG. 3 illustrates posterior view of an embodiment of a buttstock accessory port system.

FIG. 1 illustrates a left-sided view of an embodiment of buttstock accessory port system 100. System 100 includes body 105, recoil pad 110 and insert 115. Body 105 includes release lever 125 that when pressed upward pivots at lever pin 130. Lever 125 is connected to locking rod 155 by catch pin 135. When lever 125 is pressed upward this may pull locking rod 155 downward allowing body 105 to slide along a buffer tube (not shown) positioned within buffer tube sleeve 175 (as shown in FIG. 3). Body 105 further includes a bridge 140 that runs parallel to a length of body 105. Bridge 140 may include rails 150A-C that are intermittently placed along bridge 140 to reduce weight and to help contain and support insert 115. Rails 150A-C extend upward from bridge 140 and one or more of rails 150A-C may extend along bridge 140 at different lengths. Further rails 150A-C may be placed not only on the left side of bridge 140, but also the right side of bridge 140 (not seen due to perspective). Spine 160 of insert 115 may be disposed proximal to the front end of rails 150A-C. The front end of rails 150A-C is disposed at an opposite end of bridge 140 from recoil pad 110.

Figure 5:
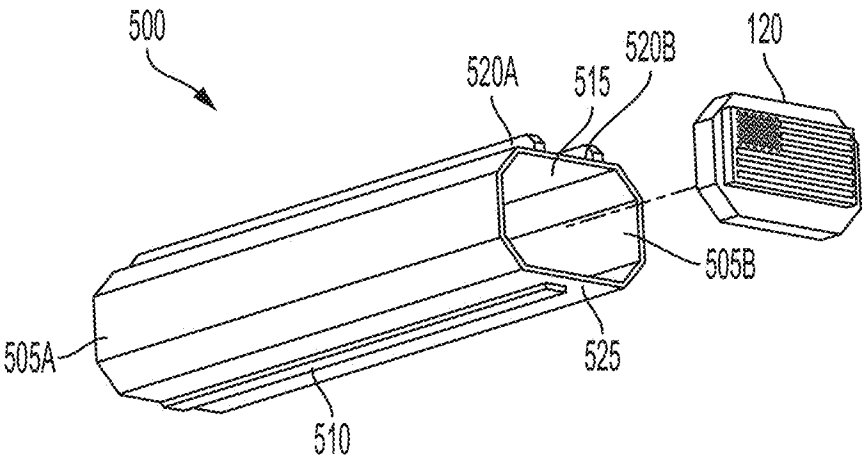
FIG. 5 illustrates a left side perspective view of an embodiment of an insert of a buttstock accessory port system.

Insert 115 may be placed in an insert cavity 170 (shown in FIG. 3). Insert 115, as depicted, may be an octagonal (or any other shaped) container open at one end (as shown in FIG. 5). For insert 115, various shapes may be used to removably fit into the insert cavity 170. As insert 115 is placed into cavity 170, spine 160, which is attached to insert 115, slides along bridge 140 such that the spine 160 is guided along the bridge 140 by one or more of rails 150A-C. Alternatively, one rail could extend the entire length of the bridge 140. Insert 115 may be placed in the insert cavity 170 such that the opening of insert 115 is towards the posterior end buttstock system 100 and the opening of insert 115 may capped with cap 120. Cap 120 may be sized in order to snugly fit inside the opening of insert 115. Recoil pad 110 may also include a recoil pad opening 190 (shown in FIG. 2) that is sized to fit cap 120. Recoil pad 110 may attach to body 105 using one or more of attachments 145A-C.

Attachments 145A-C may include one or more bolts, adhesive, hook and loop tape, snaps, magnets, rivets, or any other hardware, joinery, fastener known to one of ordinary skill in the art. Recoil pad 110 may be interchangeably attached to body 105. Further, body 105 may accommodate a recoil pad 110 of various material types (e.g., rubber, foam, leather, plastic, wood, metal) and thickness to the extent of that known in the art. Recoil pad opening 190 (shown in FIG. 2) may be sized to insert and remove one or more insert cap 120 and insert 115. Alternatively, the recoil pad opening 190 may inhibit removal of one or more of insert cap 120 and insert 115 such that the removal one or more of cap 120 and insert 115 is actuated after the removal of one or more attachments 145A-C for the purpose of ensuring that items within insert 115 are stuck or "locked" inside insert 115. Additionally, body 105 may include accessory tube 165 that extends through the entire width of body 105. Accessory tube 165 may be sized to accommodate a swivel mount which are commonly used for attaching a strap or a sling.

Figure 2:
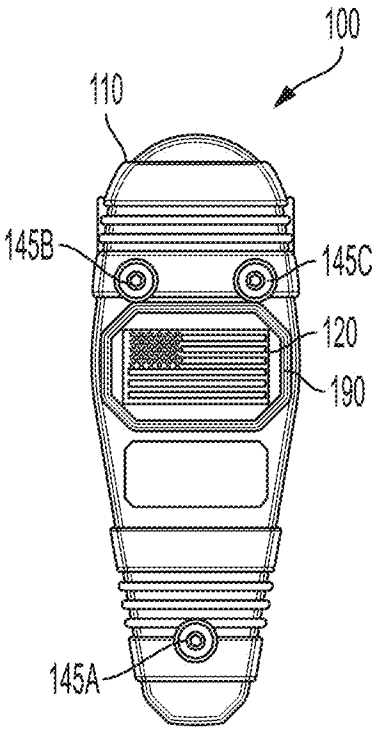
FIG. 2 illustrates posterior view of an embodiment of a buttstock accessory port system and device.

FIG. 2 illustrates posterior view of an embodiment of a buttstock accessory port system 100. Buttstock system 100 includes recoil pad 110 attached to the posterior end of buttstock system 100 using one or more attachments 145A-C. These attachments 145A-C may include one or more bolts, adhesive, hook and loop tape, snaps, magnets, rivets, or any other hardware, joinery, fastener known to one of ordinary skill in the art. Recoil pad 110 may be removably attached using one or more attachments 145A-C. Alternatively, one or more attachment 145A-C may be permanently attached. For example, attachment 145A may be permanently attached while attachments 145B-C may be removably attached such that upon remove of attachments 145B-C, recoil pad 110 may swivel on permanent attachment 145A. This may allow a user to access and/or remove insert 115 (shown in FIG. 1) while lowering the risk of dropping recoil pad 110. Recoil pad 110 may also include opening 190 sized to accommodate insert cap 120.

Figure 4:
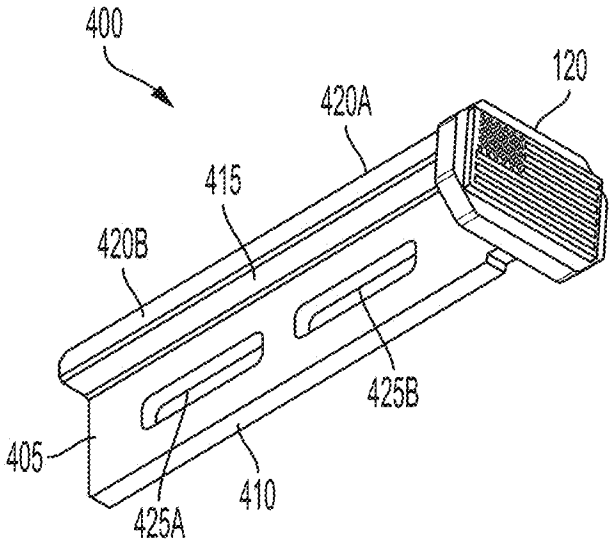
FIG. 4 illustrates a left side perspective view of an embodiment of an insert of an insert for a buttstock accessory port system.

Insert cap 120 may be permanently attached to insert 115 or removably attached to insert 115. These depictions are shown in FIG. 4 and FIG. 5, respectively. Also, opening 190 may be sized to insert and remove one or more insert cap 120 and insert 115. Alternatively, opening 190 may retain one or more of insert cap 120 and insert 115 such that their removal of insert cap 120 and/or insert 115 may be actuated after the removal of one or more attachments 145A-C. Cap 120 may be maintained in opening 190 through friction, magnet, hinge, hook and loop tape, and other attachments known in the art. Insert cap 120 may further include a surface which allows insert cap 120 to be easily and manually withdrawn through recoil pad 110.

FIG. 3 illustrates posterior view of an embodiment of a buttstock accessory port system 100 with insert cap 120 removed. Insert cap 120 is shown in FIGS. 1 and 2. Insert cavity 170 may include bottom groove 185 and top grooves 195A-B. Bottom groove 185 and top grooves 195A-C may be sized to mate with projections found on insert 115 (shown in FIGS. 1,4-5). Grooves 185 and 185A-B are sized to allow insert 115 to removably slide into cavity 170. Cavity 170 may be shaped to allow inserts of similar size and projections to slide snugly into cavity 170. Bottom groove 185 may be on the same level as bridge 140 (shown in FIG. 1). Further the outside edge of cavity 170 adjacent to bottom groove 185 may be the same height (within 5%) as rails 150A-C (shown in FIG. 1). Opening 190 in recoil pad 110 (shown in FIGS. 1 and 2) may be sized to match (within 5%) the outside edge of cavity 170 such that there are no grooves in recoil pad 110. Grooves in recoil pad 110 would inhibit the removal of insert 115 when attached to body if the insert included projections that extend outward beyond the outside edge of insert 115.

Insert 115 with a permanently attached cap 120 may be sized to fit snuggly into cavity 170 such that when recoil pad 110 (shown in FIGS. 1-2) is place in cavity 170 the cap 120 does not extent posteriorly beyond that of the recoil pad 110. Insert 115 with a removably attached cap 120 may be sized to fit snuggly into cavity 170 such that when recoil pad 110 is place in cavity 170, Insert 115, without cap 120, does not extent posteriorly beyond that of the recoil pad 110. A design may be placed on cap 120 to enhance grip when removing insert 115. If removable cap 120 does extend beyond recoil pad 110 it may extend less than half the thickness of recoil pad 110. The extension of removeable cap 120 may inhibit the sliding of the buttstock when it positioned against the shoulder of the user. However, this extension is limited to maintain the comfort of the user when the recoil pad 110 is placed firmly against the shoulder of the user. Recoil pad 110 may be comprised one or more of rubber, foam, leather, plastic, wood, metal. Generally, recoil pad 110 may include a flexible but durable material.

Body 105 may further include buffer tube sleeve 175. Buffer tube sleeve 175 is sized to mate with a buffer tube of a firearm. Accessory tube 165 may be seen positioned through the buffer tube sleeve 175. Accessory tube 165 may have open on both sides of body 105. Body 105 additionally may include one more attachment points 180A-C. Attachment points 180A-C may receive individually one or more bolts, adhesive, hook and loop tape, snaps, magnets, rivets, or any other hardware, joinery, fastener known to one of ordinary skill in the art. Depicted are attachment points 180A-C but any number of attachment points 180A-C may be used to attach recoil pad 110 to body 105.

FIG. 4 illustrates a left side perspective view of an embodiment of insert 400 for a buttstock accessory port system 100. Insert 400 may include vertical body 405 and top plate 415. Vertical body 405 includes foot 410 and accessory slots 425A-B. Vertical body 405 may attach to cap 120 such that the main portion of vertical body 405 attaches flush with the bottom edge of cap 120. However, foot 410 may attach to the bottom edge of vertical body 405 such that foot 410 extends below the bottom edge of cap 120. Foot 410, upon insertion into system 100, may be positioned to contact bridge 140 (shown in FIG. 1). Also, foot 410 is sized to slide a long side of rails 150A-B. Foot 410 may extend from the back end of vertical body 405 towards cap 120 but foot 410 may end before cap 120 after extending along the majority of the horizontal length of vertical body 405.

Further top plate 415 may be attached to the top edge of vertical body 405 and be positioned horizontally along the length of insert 400. The connection of top plate 415 and vertical body may form a "T" shape such that vertical body 405 is attached to the underside of the middle portion of top plate 415. As a result, top plate 415 may be perpendicular (plus or minus 5%) to vertical body 405. Top plate 415 may attach to the top edge of cap 120 such that the top of top plate 415 is flush with cap 120.

Extending upwards from top plate 415 may be top projections 420A (not seen due to perspective) and 420B. Projections 420A-B may extend above the top edge of cap 120. Further projections 420A-B may extend along the length of top plate 415 from the back end of top plate 415 towards cap 120. Extending along the length of top plate 415 one or more of projections 420A-B may end prior to the attachment of top plate 415 to cap 120. Similarly, to foot 410 may end before cap 120 after extending along the majority of the length of top plate 415. Because top projections 420A-B and foot 410 ends before cap 120 opening 190 on recoil pad 110 may be sized so that foot 410 and projections 420A-B may inhibit a user from removing insert 400 without removing recoil pad 110. Alternatively, opening 190 on recoil pad 110 may be sized large enough (or contain grooves matching grooves 185 and 195A-B) to allow the removal of insert 400 without the removal of recoil pad 110.

Accessory slots 425A and 425B may be implemented to connect various accessories to insert 400 whether installed within system 100 or not. Accessory slots 425A and 425B may act as connectors in a rail which allow various firearm accessories to be attached to insert 400. While not an exhaustive list, it is contemplated that flashlights, optics, sights, handles, bipods, magazines, and any other similar device that may be connected to a rail may also be connected via accessory slots 425A and 425B within insert 400.

FIG. 5 illustrates a left side perspective view of an embodiment of insert 500 of a buttstock accessory port system 100. Insert 500 is a different style of insert to that of insert 400. Insert 500 is intended to be a container that can be accessed from the back of buttstock through opening 190 found in recoil pad 110 (shown in FIGS. 1 and 2). Insert 500 may include cap 120 that covers the opening of insert 500. Cap 120 may close the opening of insert 500 through a friction attachment. Alternatively, Cap 120 may be attached by a hinge, a magnet or other attachment types known in the art.

Container insert 500 may be implemented as being polygonal in shape, as depicted in FIG. 5, or implemented in an oval or a round opening or any other shape. Recoil pad opening 190 and cavity 170 may be sized to match the size of insert 500 even though the shape of opening 190 may not need to be altered. Further, top projections 520A-B and foot 510 may be implemented on any shape capable of fitting within recoil pad opening 190 and cavity 170. An exemplary polygonal insert 500 may include left and right panels 505A-B and upper panel 515 and lower panel 525. Upper panel may include projections 520A-B sized to slide into top grooves 195A-B (shown in FIG. 3) respectively. Projections 530A-B may or may not extend to the end of container insert 500. Lower panel 535 may include foot 510 that extends outward from bottom panel 525. The extension of the panel outward corresponds to bottom groove 185 (shown in FIG. 3). Foot 510 may end before the opening of container insert 500 but alternatively, foot 510 may end at the opening of insert 500.

Container insert 500 may be used to fit spare batteries, extra rounds of ammunition, firearm cleaning equipment, ear plugs, money, tools for adjusting a scope, a choke, or jewelry that may interfere with shooting. Other container inserts 500 may be sized to fit inside container insert 500 to limit the rolling around of objects. For example, a battery holding case or a baffle may be sized to hold several batteries and may be able to slide inside polygonal container insert 500 and not roll around inside container insert 500. Further, container insert 500 may be waterproof to hold important papers such as a hunting license, money, letters etc.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A buttstock system, comprising:
a body comprising:
a cavity,
a bridge disposed within the cavity;
a recoil pad attached to an end of body comprising:
an opening; and
an insert that is insertable through the opening in the recoil pad and insertable into the cavity of the body.

2. The buttstock system of claim 1, wherein bridge further comprises one or more rail.

3. The buttstock system of claim 2, wherein the rail extends upward from a top portion of the bridge.

4. The buttstock system of claim 1, the recoil pad further comprising:
a cap sized to fit into the recoil pad opening.

5. The buttstock system of claim 1, the insert further comprising:
a cap permanently fixed on an end of the insert.

6. The buttstock system of claim 1, the insert further comprising:
a cap attachable on an end of the insert.

7. The buttstock system of claim 5, where the insert is removeable through the posterior end of the buttstock and the recoil pad.

8. The buttstock system of claim 7, the body further comprising:
a top groove.

9. The buttstock system of claim 8, the insert further comprising:
a bottom projection that slides through the bottom groove.

10. The buttstock system of claim 1, the body further comprising:
a bottom groove.

11. The buttstock system of claim 10, the insert further comprising:
a top projection that slides through the top groove.

12. The buttstock system of claim 1, wherein the insert further comprises:
a vertical body comprising:
a foot attached to a bottom portion of the vertical body; and
a top plate attached to the vertical body comprising:
a top projection attached to a top portion of the top plate,
a cap attached to the vertical body and the top plate.

13. The buttstock insert of claim 12, wherein the top projection, attached to the top portion of the top plate, ends before connecting to an outside edge of the top plate.

14. The buttstock insert of claim 12, wherein the bottom projection, attached to the bottom portion of the vertical plate, ends before connecting to an outside edge of the bottom plate.

15. The buttstock insert of claim 12, wherein the vertical plate further comprises:
one or more slots.

16. The buttstock insert of claim 12, wherein the cap includes a textured exterior surface.

17. The buttstock system of claim 1, wherein the insert further comprises:
a top plate comprising:
one or more projections extending upward from the top plate;
a bottom plate comprising:
one or more projections extending downward from the bottom plate; and
a side plate connected to both the bottom plate and connected to the top plate.

18. The buttstock insert of claim 17, further comprising:
an opening at one end of the insert.

19. The buttstock insert of claim 17, further comprising:
a cap sized to be removably inserted into the insert opening.

20. The buttstock of claim 17 wherein one of the one or more projections ends before the insert opening.

* * * * *